United States Patent [19]

Anderson

[11] 4,385,872

[45] May 31, 1983

[54] COMPRESSOR

[75] Inventor: Robert L. Anderson, De Graff, Ohio

[73] Assignee: Copeland Corporation, Sidney, Ohio

[21] Appl. No.: 114,346

[22] Filed: Jan. 22, 1980

[51] Int. Cl.[3] ..... F04B 21/02; F04B 39/10

[52] U.S. Cl. ..... 417/571; 417/566

[58] Field of Search ..... 417/559, 562, 564, 571

[56] References Cited

U.S. PATENT DOCUMENTS

| | | | |
|---|---|---|---|
| 1,185,412 | 5/1916 | Kramer | 417/454 |
| 1,407,518 | 2/1922 | Donnely | 137/543.17 |
| 1,659,817 | 2/1928 | Halvorsen | 417/454 |
| 1,871,285 | 8/1932 | Torsdy | 417/567 |
| 2,025,240 | 12/1935 | Higham | 417/539 |
| 2,366,004 | 12/1944 | Crittonden | 137/543.19 |
| 2,831,625 | 4/1958 | Hartwell et al. | 417/564 |
| 3,944,381 | 3/1976 | Dirk | 417/564 |
| 4,032,266 | 6/1977 | Roeder | 417/571 |
| 4,060,098 | 11/1977 | Bares | 417/564 |

FOREIGN PATENT DOCUMENTS

| | | | |
|---|---|---|---|
| 1503928 | 4/1969 | Fed. Rep. of Germany | 417/566 |
| 2426378 | 1/1975 | Fed. Rep. of Germany | 417/562 |
| 812820 | 5/1937 | France | 417/571 |
| 1374783 | 11/1974 | United Kingdom | 417/298 |

*Primary Examiner*—William L. Freeh

*Attorney, Agent, or Firm*—Harness, Dickey & Pierce

[57] ABSTRACT

There is disclosed an improved compressor cylinder head fabricated out of two separate parts to reduce cost and facilitate assembly, and an improved compressor valve plate for use with said cylinder head which utilizes multiple parts to provide concentric suction and discharge passages. A novel method of fabricating the valve plate is also disclosed.

6 Claims, 4 Drawing Figures

FIG. 1.
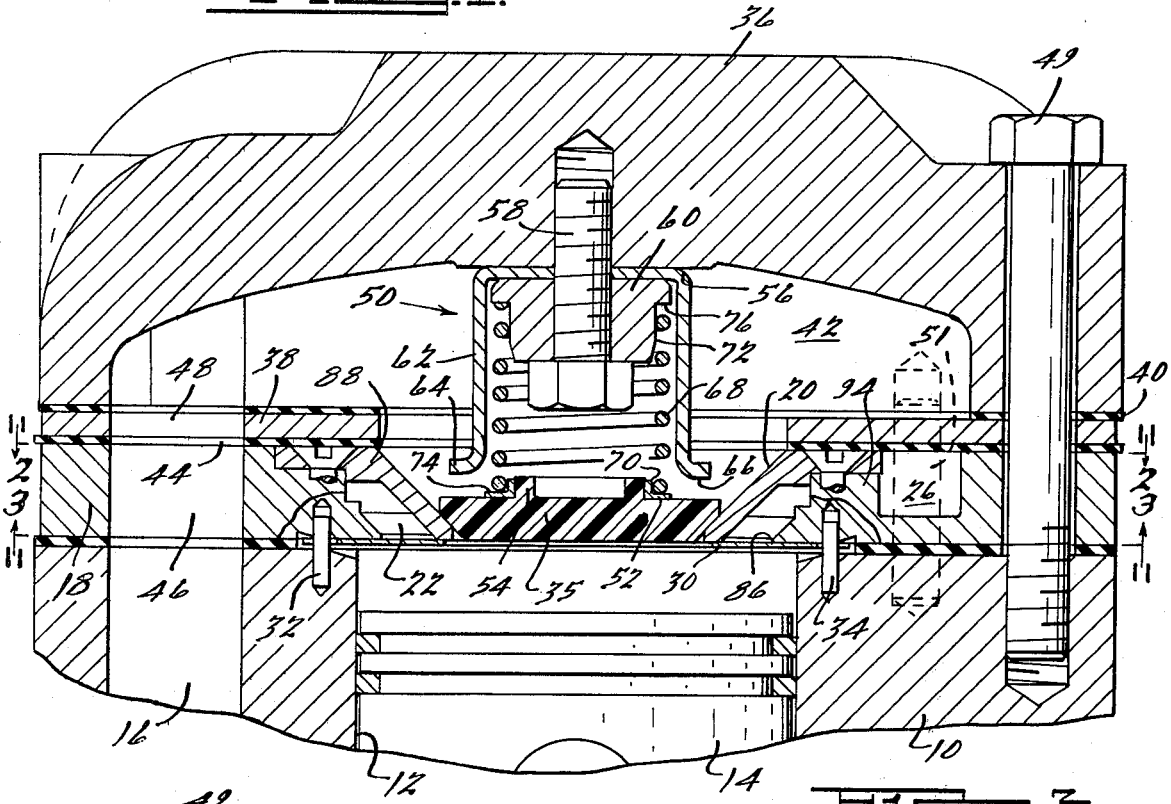
FIG. 3.
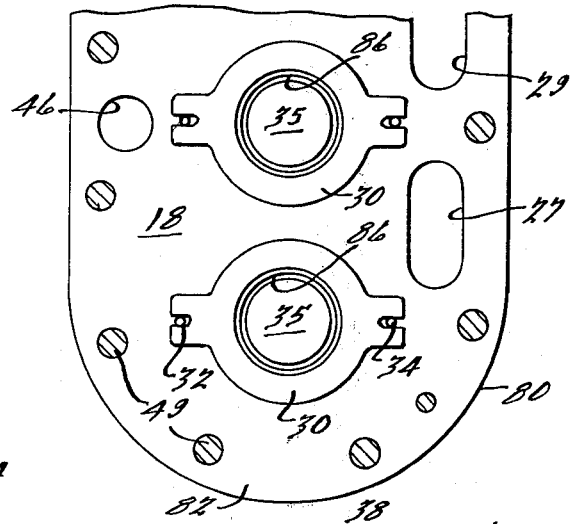
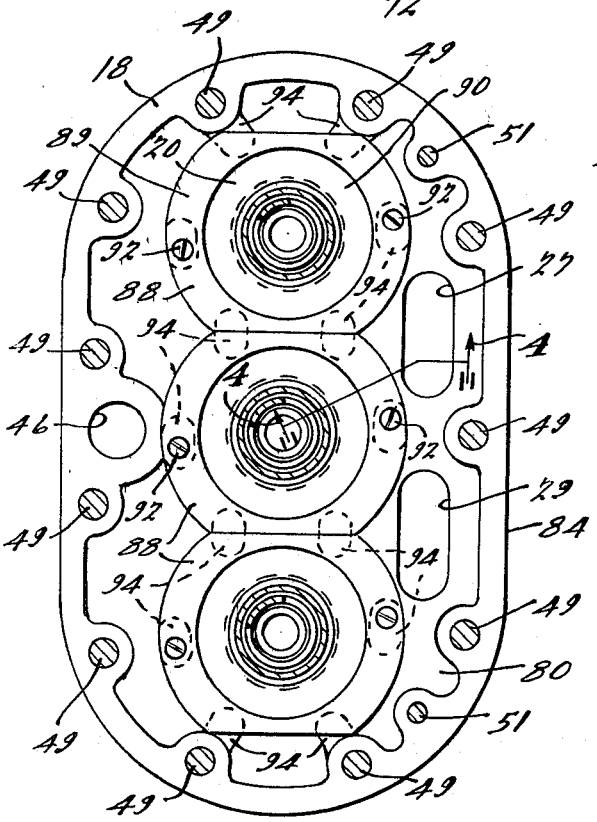
FIG. 2.
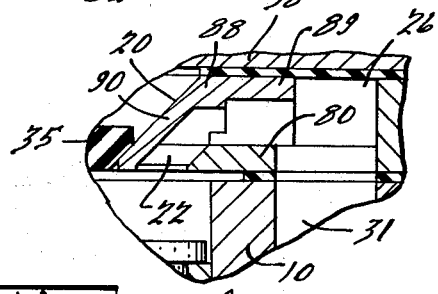
FIG. 4.

COMPRESSOR

BACKGROUND AND SUMMARY OF THE INVENTION

The present invention relates generally to compressor valve plate and head assemblies and a method of fabricating same, and more particularly to such assemblies particularly adapted for use on refrigeration compressors. Although the invention is applicable to rotary and other type compressors, including single and multi-cylinder types, it is disclosed herein embodied in a multi-cylinder reciprocating piston type compressor which can be of either hermetic or accessible hermetic type.

The embodiment of the present invention disclosed herein is particularly suited for use with disc-like lightweight valves of the type disclosed in assignee's copending application, Ser. No. 971,309, filed Dec. 20, 1978, now abandoned, and the valve biasing means forming the subject matter of assignee's copending application in the name of Dale T. Chambers, entitled "Discharge Valve", Ser. No. 114,345, now U.S. Pat. No. 4,329,125, filed of even date. The valve plate of the present invention is an improvement over the valve plates disclosed in the aforesaid '309 application.

Valve plates and cylinder head assemblies can become relatively complex in configuration for certain valve arrangements and as a result are quite costly to manufacture and sometimes to assemble.

It is therefore a primary object of the present invention to provide improved valve plates and head assemblies for use in compressors having concentric suction and discharge valves for each pumping chamber, which assemblies are relatively simple and inexpensive to manufacture, which are easy to assemble, which are reliable in operation, and which can be retrofit on certain existing compressors previously utilizing different valve arrangements. A related object resides in the provision of an improved method for fabricating such assemblies.

Additional advantages and features of the present invention will become apparent from the subsequent description and appended claims, taken in conjunction with the accompanying drawings.

BRIEF DESCRIPTION OF THE DRAWINGS

FIG. 1 is a fragmentary sectional view of a portion of a refrigeration compressor embodying the principles of the present invention;

FIG. 2 is a view taken along line 2—2 in FIG. 1;

FIG. 3 is a partial view taken along line 3—3 in FIG. 1; and

FIG. 4 is a sectional view taken along line 4—4 in FIG. 1.

DESCRIPTION OF THE PREFERRED EMBODIMENT

With reference to the drawings, there is illustrated a portion of a multi-cylinder, semi-hermetic refrigeration compressor comprising a cylinder block 10 having three cylinders 12 therein in each of which is disposed a conventional reciprocating piston 14 to define the usual pumping chamber, and a discharge gas passage 16 communicating between the upper surface thereof and the compressor discharge line (not shown). Mounted on the upper face of cylinder block 10 is a valve plate 18 generally having means defining for each cylinder a conical valve seat and discharge passageway 20 and an annular suction gas inlet passageway 22, the latter communicating with a suction gas supply chamber 26, which in turn communicates with the other cylinders in the compressor and the usual supply of suction gas to the compressor via passages 27 and 29. Discharge passageway 20 and inlet passageway 22 are arranged concentrically with respect to each cylinder. A suitable gasket 28 is disposed between the valve plate and cylinder block.

A conventional ring suction reed valve 30 is located in each cylinder on the lower surface of the valve plate for controlling the flow of suction gas through passageway 22 in the usual manner. Each suction valve 30 is positioned in the conventional manner by pins 32 and 34 mounted in cylinder block 10. A suction valve of this general type is illustrated in the aforesaid '309 application. Each valve seat 20 has disposed therein a lightweight compliant polymeric discharge valve 35 of the type described in detail in assignee's aforesaid '309 application.

Disposed on the outer surface of valve plate 18 is a unique cylinder head assembly comprising a cylinder head 36 and a plate member 38 disposed on the lower surface thereof, a conventional gasket 40 being positioned between the respective parts. Plate member 38 may be a simple metal stamping. The configuration of plate member 38 and head 36 defines a head assembly which would be extremely expensive to fabricate in one piece, but which may be inexpensively fabricated in accordance with the present invention from a simple casting, a simple stamping and a gasket. This cylinder head assembly defines a discharge chamber 42 communicating with each valve seat and discharge passageway 20, plate 38 functioning to separate discharge chamber 42 from suction gas supply chamber 26 and passages 27 and 29. A gasket 44 is provided between plate member 38 and valve plate 18 to provide the requisite sealing. Valve plate 18 and plate member 38 are provided with aligned openings 46 and 48 respectively, which function to place discharge chamber 42 in communication with discharge passage 16 in cylinder head 10.

The overall assembly is secured together by means of a plurality of bolts 49 which pass through cylinder head 36, plate member 38, valve plate 18, and threadably engage cylinder block 10. The assembly (less cylinder head 36) may be aligned and held in position on the cylinder block, prior to the addition of cylinder head 36 and bolts 49, by means of a pair of alignment pins 51. Cylinder head assemblies are generally quite heavy and difficult to handle during assembly, especially if the cylinders are inclined as they are in many compressors. The fact that the cylinder head assembly of the present invention may be assembled in two parts, with plate member 38 aligned and held in position on the cylinder block by pins 51 prior to assembly of head 36, greatly facilitates overall assembly. It also provides access to the discharge valve so that it is easier to assemble the discharge valve biasing parts.

Another unique feature of the present invention is the manner in which valve plate 18, which is somewhat complex in configuration, is constructed. Specifically, it comprises a body 80 having a flat lower surface 82 and a raised upper peripheral edge 84 through which bolts 49, pins 51 and opening 46 pass. Peripheral edge 84 has a flat upper surface which is parallel to lower surface 82. The center depressed portion of body 80 is provided with a circular aperture 86 coaxial with each cylinder, which aperture defines the outer peripheral edge of each suction gas inlet passageway 22. For each cylinder there is provided a separate insert in the form of a ring valve seat member 88 comprising an upper mounting flange 89 and a downwardly and inwardly extending conical portion 90 having valve seat 20 on its inner peripheral surface and defining by its outer periphery the inner peripheral edge of annular suction gas inlet passageway 22. Conical portion 90 extends down into aperture 86 and is supported on body 80 concentrically with respect to each cylinder by means of threaded fasteners 92 passing through mounting flange 89 and cooperating with appropriately spaced and shaped pads 94 integrally formed on body 80 (FIG. 2). Suction gas supply chamber 26 is the open space between the depressed central portion of body 80 inside peripheral edge 84, the plane of the upper surface of edge 84 and the outside of the ring valve seat members.

Fabrication of the valve plate assembly is relatively easily accomplished. For example, body 80 can be cast in open form (no coring, etc.) and then rough machined, including machining bottom surface 82 flat, machining the top surfaces of pads 94 to the proper height with respect to surface 82, and drilling or machining all of the necessary holes and apertures. Each ring valve seat member 88 may be rough machined on the outside surface and then assembled to body 80 using fasteners 92. Thereafter the top and bottom surfaces of the entire assembly may be finish-ground flush to the desired flatness, thickness and parallelness. Ideally, each valve seat 20 (i.e., the inside surface of each ring valve seat) should be machined as the very last operation; however, if this is not possible because of problems in handling (and perhaps rotating) the entire assembly, then seat 20 can be finish-ground prior to assembly of ring valve seat members 88 to body 80.

The discharge valve assembly for each cylinder is generally indicated at 50 and is disposed within discharge chamber 42. Each assembly comprises a first annular hardened steel seat 52 mounted on the upper (as shown) or discharge-chamber-face of valve 35. Seat 52 is retained in place by means of an integrally formed annular shoulder 54 on each valve 35. Cylinder head 36 is provided with a flat support surface 56 which is parallel to each valve 35 and in opposing relationship with respect thereto. Affixed to each surface 56 and cylinder head 36 by means of a conventional machine screw 58 is a second annular hardened steel seat 60 and a cylindrical cup-shaped sheet metal spring guide 62 having about the lower surface thereof a radially outwardly projecting flange 64 defining, on the lower surface thereof, a continuous uninterrupted annular stop surface 66 lying in a plane parallel to adjacent valve 35 and spaced therefrom a predetermined distance for limiting the opening movement of the valve.

A compression coil spring 68 is supported by and compressed between each pair of seats 52 and 60 and operates to bias each valve 35 in a closing direction. As can be seen, each spring guide 62 extends for a substantial portion of the axial length of its spring 68 and is in close but spaced proximity thereto. To prevent unnecessary movement, spring 68 and seats 52 and 60 are sized so that each spring is a slip-fit over a cylindrical surface 70 on its seat 52 and a cylindrical surface 72 on its seat 60. Each spring 68 has closed and ground ends engaging parallel annular surfaces 74 and 76 on seats 52 and 60, respectively, and is preferably formed of chromium-silicon wire, having approximately two inactive coils at each end for dampening. This discharge valve assembly forms the subject matter of assignee's aforesaid copending Chambers application, filed of even date. The operation of the valve is believed to be self-evident from an understanding of the present disclosure.

Thus, there is disclosed in the above description and in the drawings an improved compressor which fully and effectively accomplishes the objectives thereof. However, it will be apparent that variations and modifications of the disclosed embodiment may be made without departing from the principles of the invention or the scope of the appended claims.

I claim:

1. A valve plate for a compressor pumping chamber, said valve plate comprising:

a relative flat body having a planar bottom surface lying in a first plane and a raised continuous ridge disposed about its periphery, the upper surface of said ridge lying in a second plane parallel to said first plane;

means defining at least one gas flow opening through said body through which gas is adapted to pass to and from a single pumping chamber;

a plurality of pads integrally formed on said body around each said opening, the upper surface of each said pad lying in a common plane disposed between the planes of said bottom surface and ridge;

an insert for each said opening having a mounting flange disposed on a plurality of said pads, said insert being affixed to said body and including a downwardly and inwardly extending wall projecting into said opening, the outer surface of said wall defining with said opening an annular suction passage and the inner surface of said wall defining a discharge passage; and means defining a discharge valve seat on said inner surface of said insert wall.

2. The valve plate as claimed in claim 1, wherein said discharge seat is conical in configuration.

3. The valve plate as claimed in claim 1, wherein said body has a plurality of said openings for a plurality of pumping chambers, each of said suction passages being in fluid communication with one another within the space defined by said first and second planes.

4. The valve plate as claimed in claim 1, further comprising a generally flat plate member disposed on the upper surface of said ridge, said plate member cooperating with said ridge and each said insert to define an enclosed suction gas chamber in fluid communication with each said suction passage and separate from each said discharge passage.

5. A valve plate for a compressor pumping chamber, said valve plate comprising:

a relative flat body having a planar bottom surface and a raised continuous ridge disposed about its periphery, the upper surface of said ridge lying in a plane parallel to said bottom surface;

means defining at least one gas flow opening through said body through which gas is adapted to pass to and from a single pumping chamber; and an insert for each said opening affixed to said body and including a wall projecting radially inwardly and downwardly into said opening, said insert having an upper surface positioned substantially coplanar with said upper surface of said ridge, said wall defining an annular suction passage and a separate concentric discharge passage.

6. The valve plate as claimed in claim 5, further comprising a generally flat plate member disposed on the upper surface of said ridge, said plate member cooperating with said ridge and each said insert to define an enclosed suction gas chamber in fluid communication with each said suction passage and separate from each said discharge passage.

* * * * *